United States Patent [19]

Nance

[11] Patent Number: 5,013,005

[45] Date of Patent: May 7, 1991

[54] BLOWOUT PREVENTER

[75] Inventor: James G. Nance, Spring, Tex.

[73] Assignee: Cameron Iron Works, Inc., Houston, Tex.

[21] Appl. No.: 134,084

[22] Filed: Dec. 17, 1987

Related U.S. Application Data

[63] Continuation of Ser. No. 853,601, Apr. 18, 1986, abandoned.

[51] Int. Cl.[5] ..... F16K 3/02

[52] U.S. Cl. ..... 251/1.3; 277/126

[58] Field of Search ..... 251/1.1, 1.2, 1.3; 277/126, 207 R

[56] References Cited

U.S. PATENT DOCUMENTS

| | | | |
|---|---|---|---|
| 2,746,710 | 5/1956 | Jones | 251/1.3 |
| 2,855,172 | 10/1958 | Jones | 251/1.3 |
| 2,947,508 | 8/1960 | Allen | 251/1.3 |
| 3,554,278 | 1/1971 | Reistle, III et al. | 251/1.3 |
| 3,817,326 | 6/1974 | Meynier, III | 251/1.3 |
| 3,955,622 | 5/1976 | Jones | 251/1.3 |
| 4,043,389 | 8/1977 | Cobb | 166/55 |
| 4,057,887 | 11/1977 | Jones et al. | 29/240 |
| 4,215,747 | 8/1980 | Cox et al. | 251/1.3 |
| 4,229,012 | 10/1980 | Williams, III | 251/1.3 |

*Primary Examiner*—John C. Fox

[57] ABSTRACT

A blowout preventer with a body having a central bore and aligned, opposed guideways extending outward from said central bore, a ram in each of said guideways, means for moving the rams in the guideways, each ram having a ram body with a pair of vertical face recesses and a face slot for receiving an improved packer including a packer body of resilient material with two vertical recesses aligned with the ram body recesses, said packer body also having tubing supporting means and a tubing sealing means.

1 Claim, 4 Drawing Sheets

BLOWOUT PREVENTERThis application is a continuation of pending application Ser. No. 06/853,601, filed on Apr. 18, 1986, now abandoned.

BACKGROUND

Blowout preventers are used on wells to control the pressure which may build within the well. They have been used on wells to close on dual tubing strings. It is desirable that when running or pulling such strings that they be supported by the blowout preventer rams. Normal support of a tubing string by a blowout preventer is accomplished by resting the joint enlargement on the rams. With dual strings in more recent wells which are much deeper, such support of both strings on the rams is not possible because the joints are normally vertically staggered and the length of the strings are such that both would not be supported adequately with only one resting on the rams. Additionally, tubing strings have safety valves installed therein and require the running of their control lines, often in encapsulated form along the exterior of the strings. Supporting the dual strings with their encapsulated control lines on a blowout preventer has not been possible with existing structures.

One prior blowout preventer structure was suitable for handling dual strings. It included an upper set of rams which sealed on the dual strings after they had been properly oriented by the lower set of rams. This structure is shown in U.S. Pat. No. 4,215,747. Another prior structure includes shear rams in an upper preventer and slip bowl rams in the lower preventer as shown in U.S. Pat. No. 4,043,389.

A blowout preventer structure shown in U.S. Pat. No. 4,057,887 includes upper and lower rams for a single string which has its shoulder supported on the lower ram, the upper and lower rams provide sealing on the string and intermediate rams are used for unthreading the string at the joint resting on the lower ram.

U.S. Pat. Nos. 2,746,710, 2,855,172, 2,947,508 and 4,229,012 all disclose blowout preventer structures in which the packing includes a series of inserts which support the packing material and which can move inwardly in varying degrees to accommodate the shape of the string on which the rams close. None of these structures are suitable for supporting dual strings and their encapsulated control lines and sealing about the dual strings and the control line.

SUMMARY

The present invention relates to an improved blowout preventer which is capable of handling dual tubing strings with their attached encapsulated control lines and of supporting each of the tubing strings on the rams and of sealingly engaging the tubing strings and control lines. The blowout preventer structure includes a body with a vertical bore and guideways extending outward from opposite sides of the bore, rams in each guideway, and means for moving the rams in the guideways, each of the rams having a body with a resilient packer in its front slot, the packer having dual recesses with a plurality of movable supporting slips embedded in the packer in each of its recess and reinforcing inserts embedded in the packer. Prior to closing the rams of the improved blowout preventer of the present invention, the dual tubing strings should be properly oriented so they will be correctly engaged by the rams. One method of accomplishing this is to use the aligning apparatus disclosed in U.S. Pat. No. 4,215,747 installed above the blowout preventer of the present invention.

An object of the present invention is to provide an improved blowout preventer suitable for sealing on dual tubing strings with their encapsulated control lines.

Another object is to provide an improved single blowout preventer for supporting and sealing on dual tubing strings.

A further object is to provide improved blowout preventer rams suitable for supporting and sealing against dual tubing strings and their attached encapsulated control lines.

DESCRIPTION OF THE DRAWINGS

These objects and advantages of the present invention are hereinafter set forth and explained with reference to the drawings wherein.

BRIEF DESCRIPTION OF THE PREFERRED EMBODIMENT

Figure 1:
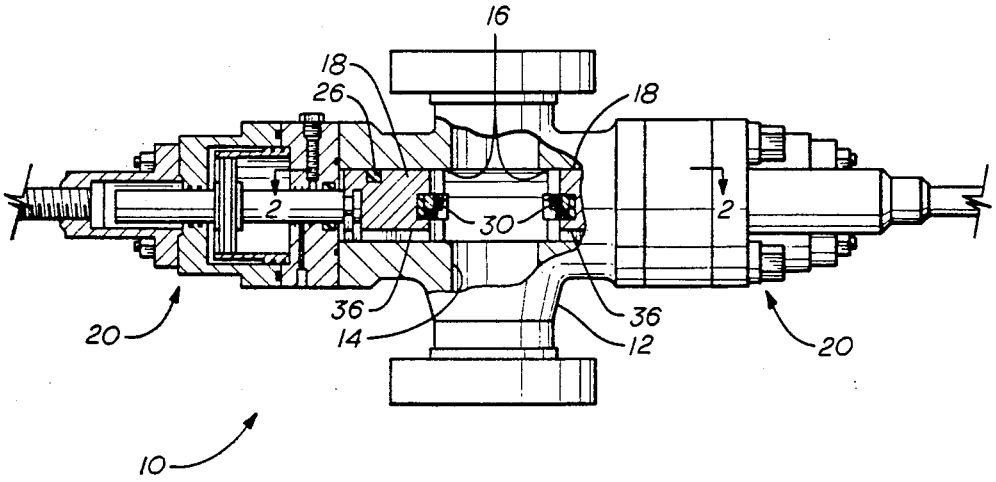
FIG. 1 is an elevation view with portions in section to show the open rams within the body.
Figure 2:
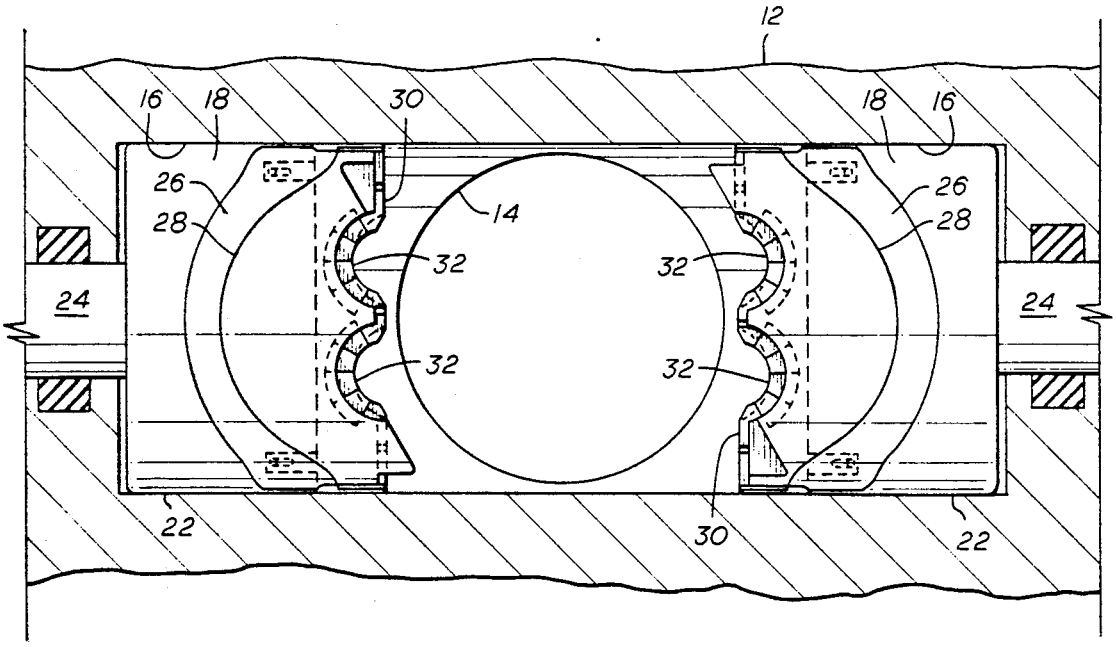
FIG. 2 is a sectional view taken along 2—2 in FIG. 1.
Figure 3:
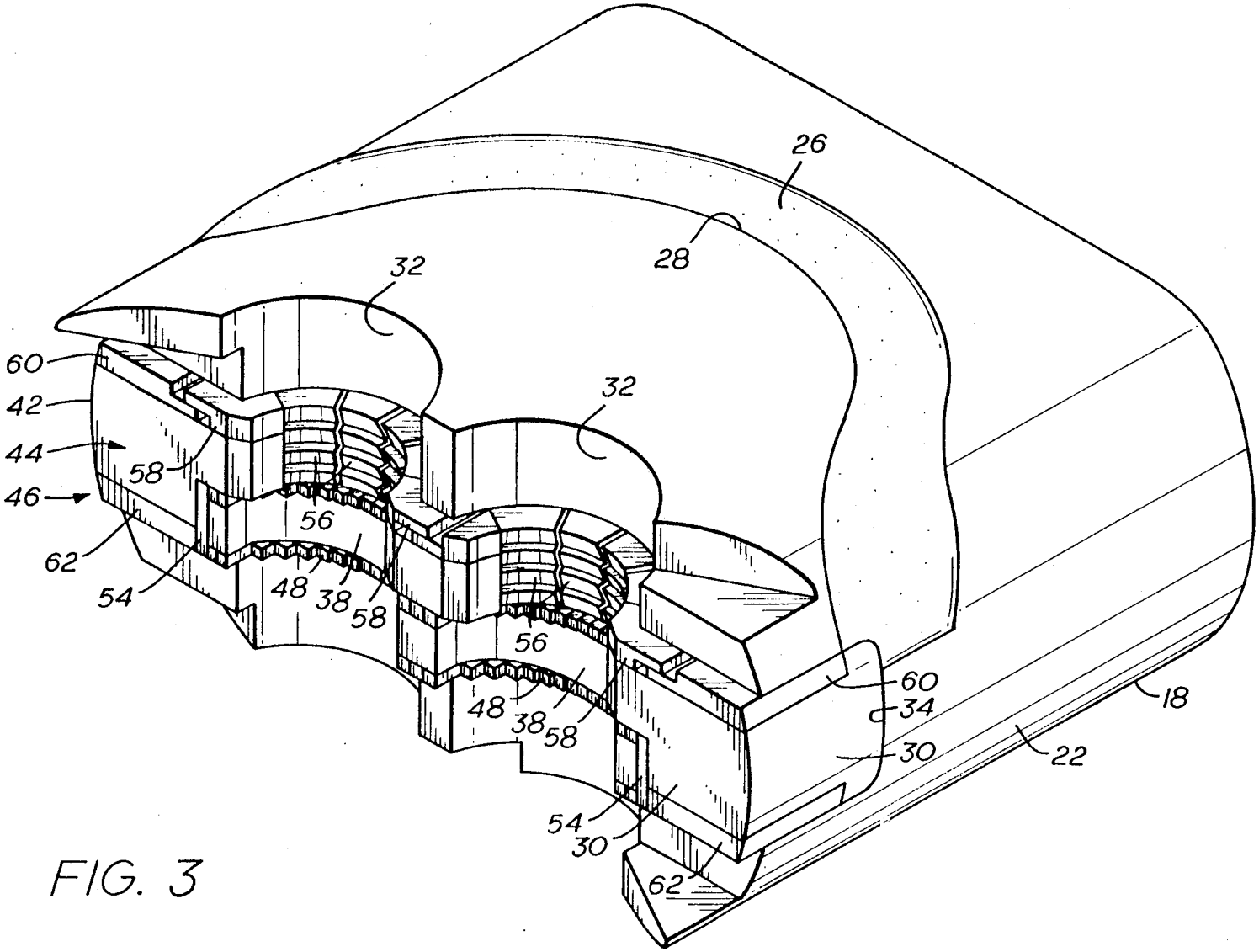
FIG. 3 is a perspective view of one of the improved rams of the present invention.
Figure 5:
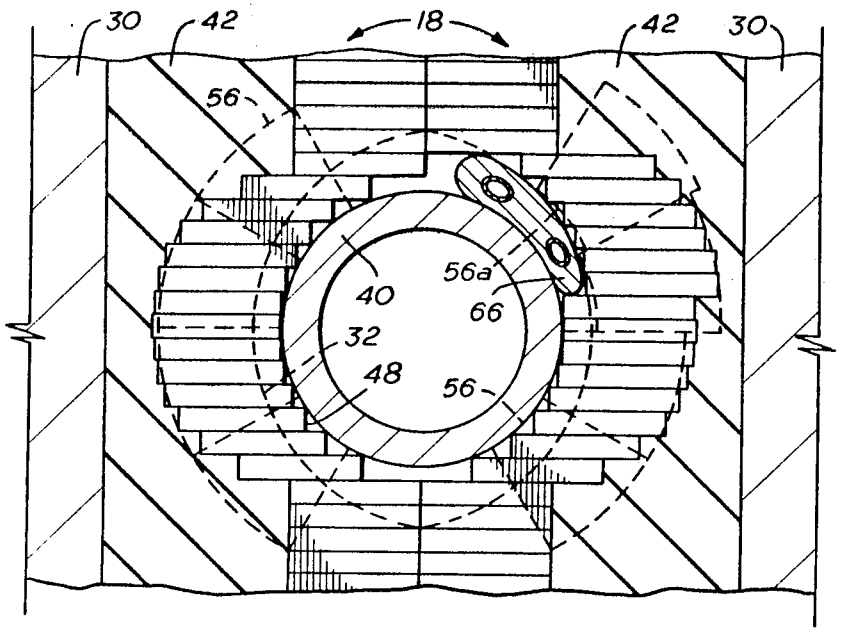
FIG. 5 is a partial view similar to FIG. 4 showing the position of the ram closed but with the encapsulated control line in a different position.

Improved blowout preventer 10, as shown, includes body 12 having vertical bore 14 extending therethrough and opposed aligned guideways 16 extending outward from bore 14. Rams 18 are movably positioned within guideways 16 and are moved therein by suitable pressure responsive means 20, such as pistons. As shown in FIGS. 2 and 3 rams 18 each include body 22 which includes suitable means 24 for connecting to pressure responsive means 20, top seal 26 positioned in groove 28 extending across the top of body 22 and into sealing engagement with the sides of packer 30 at the sides of body 22. The inner or front face of body 22 includes two semicircular vertically extending recesses 32 and transverse slot 34 opening to bore 14. Mud slot 36 extends along the lower portion of body 22 to provide communication from bore 14 below rams 18 to the rear or outer face of body 22.

Figure 6:
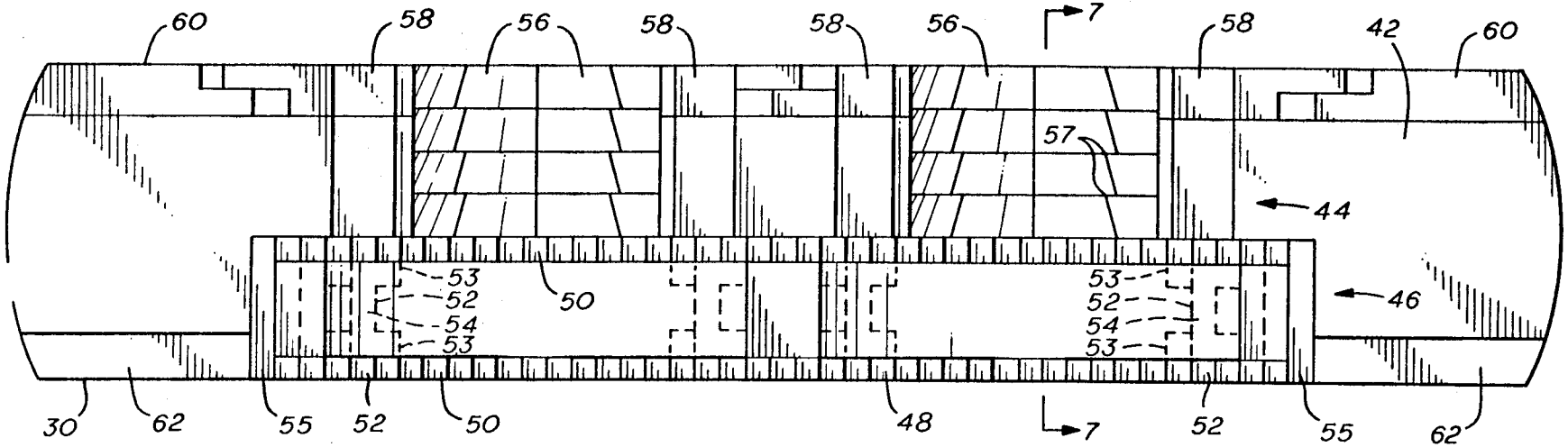
FIG. 6 is a front view of the improved packer of the present invention.
Figure 6A:
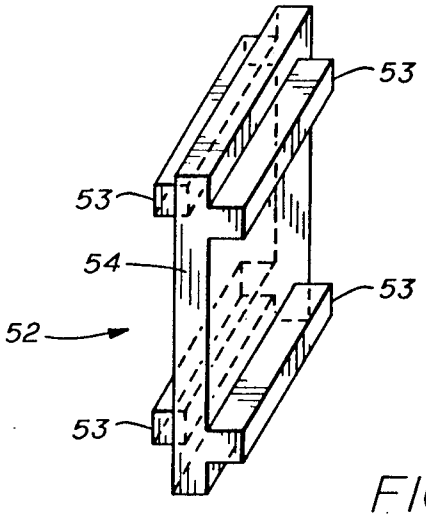
FIG. 6A is a perspective view of the special end inserts at each end of of each of the recesses in lower sealing section.

As can be seen in FIG. 3, packer 30 is positioned in transverse slot 34 of ram body 22 and each packer 30 has two semicircular vertically extending recesses 38 for closing on dual production strings 40 (FIGS. 4 and 5) extending through bore 14. Each packer 30 includes resilient packing 42 having upper gripping section 44 and lower sealing section 46. Lower sealing section 46 includes a plurality of upper metal inserts 48 and lower metal inserts 50 embedded in resilient packing 42. As best seen in FIGS. 4 through 7, each insert 48 and 50 is a strip positioned parallel to the axis of its ram. Additionally, special end inserts 52 are embedded in packing 42 at each side of the recesses 38. Inserts 52 include upper and lower flanges 53 with integral neck 54 extending between flanges 53, as shown in dashed lines in FIG. 6. Special end insert 52 shown in FIG. 6A is adapted to be positioned at the right hand sides of recesses 38 when viewed as shown in FIG. 6 and a mirror image of the illustrated insert is adapted to be positioned at the left hand sides of recesses 38. Inserts 48, 50 and 52 provide a reinforcement for resilient packing 42. End plates 55 are provided at each side of the lower sealing section. Upper gripping section 44 includes a plurality of slip segments 56 embedded in packing 42 in surrounding relationship to recesses 38. Each of slip segments 56 has a plurality of upwardly facing teeth 57 (FIG. 7) facing inwardly toward the center of their recesses 38. Support segments 58 are positioned at the inner edges of gripping section 44 in supporting relationship to slips 56 to assist in maintaining slips 56 in their desired relationship in position to come into gripping engagement with the production string in its recess. Upper plates 60 are positioned on the upper surface of packing 42 at each side of gripping section 44. Lower plates 62 are positioned on the lower surface of packing 42 at each side of sealing section 46 as clearly shown in FIGS. 3 and 6.

Figure 7:
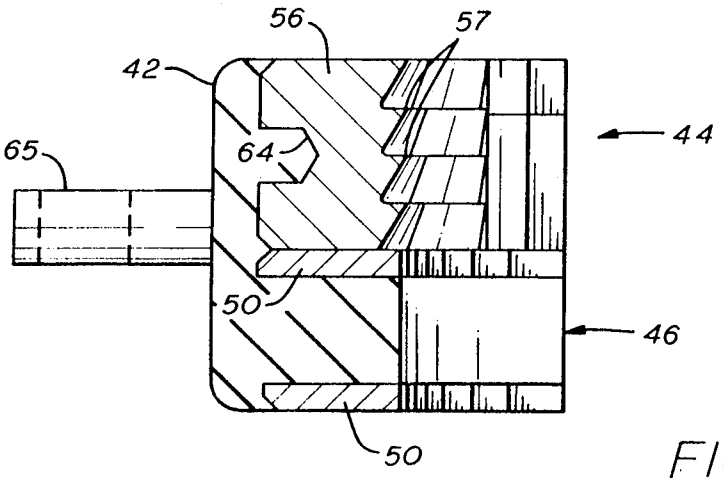
FIG. 7 is a sectional view of the packer taken along line 7—7 in FIG. 6.

The specific structure of each slip 56 and inserts 48 and 50 is shown in FIG. 7. From this it can be seen clearly that they are embedded in resilient packing 42 with the material of packing 42 between inserts 48 and 50 and also positioned in recess 64 in the rear surface of slips 56. Pins 65 secured to packer 30 are used to secure packer 30 to its ram 18 in a manner known in the art and disclosed in U.S. Pat. No. 3,817,326 and others.

Figure 4:
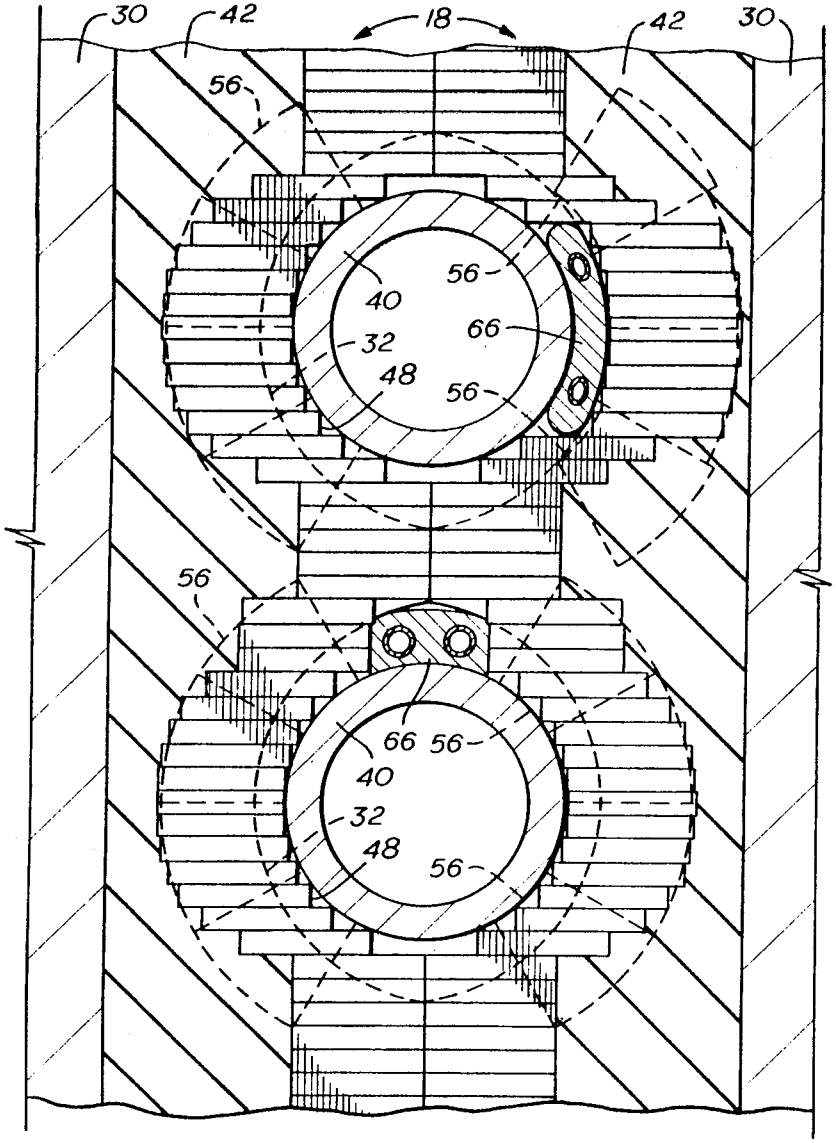
FIG. 4 is a sectional plan view of the blowout preventer shown schematically to illustrate the closing on tubing strings.

In FIG. 4, a view of rams 18 of blowout preventer 10 is illustrated closed on dual production strings 40. Each of strings 40 includes its own attached encapsulated control line 66. In one of recesses 32, control line 66 is positioned on the side of string 40 facing the center of the ram which is engaging string 40. In this position, encapsulated control line 66 is compressed radially and extends circumferentially so that it is engaged by the center two slips and the other two slips move into direct gripping engagement with string 40. The two slips on one side and four slips in the other recess 32 engaging the other string 40 is sufficient engagement to fully support the weight of both strings. The other string 40 is shown with its control line 66 positioned at the side so that when engaged, as shown, it is compressed from the side so that it is slightly smaller in the circumferential direction with respect to string 40 and is slightly larger in the radial direction. Both strings 40 are supported and packer 30 seals against them.

FIG. 7 illustrates another possible position of control line 66 with respect to upper gripping section 44. In this position control line 66 is engaged by the two slips on the side of the recess and is partially compressed radially and the portion of the encapsulation at the side of the side slip **56*a* is slightly expanded radially and circumferentially. In all positions which control lines 66 may assume the pipe strings 40 are properly supported and rams 18 are set against and seal around strings 40 and encapsulated control lines 66**.

What is claimed is:

1. A blowout preventer comprising a body having a vertical bore therethrough and opposed aligned guideways extending outward from said bore, a ram in each of said guideways, means for reciprocating said rams in said guideways to retract from said bore and to move into said bore, each of said rams having a ram body having a packer receiving slot across its front surfaces facing said bore and dual arcuate recesses extending through the front face of said ram body in a direction parallel to the axis of said vertical bore, seal means for sealing between the top and sides of said ram body and the walls of the guideway in which it is positioned, and a packer of resilient material positioned in said receiving slot having its sides in engagement with said seal means to complete the side sealing against the walls of its guideway, said packer having dual arcuate front recesses aligned with the recesses of said ram body, a plurality of tube supporting means lining a substantial portion of the recesses of said packer and a plurality of independently movable inserts embedded in said packer to support the resilient materail in sealing position against a tubing string and its encapsulated control lines, said tube supporting means including a plurality of gripping slips embedded in said packer and being movable radially of their recess to move into tight gripping engagement with a tubing string extending through said recess, said inserts including a a plurality of strip shaped inserts embedded in said packer immediately below said gripping slips parallel to the axis of their ram, a plurality of strip shaped inserts embedded in said packer on the lower surface of said packer parallel to the axis of their ram, an end insert embedded in said packet at each side of said arcuate recesses, each of said end inserts having upper and lower flanges, and an integral neck extending between said flanges.

* * * * *